United States Patent [19]

D'Angelo

[11] 4,119,255

[45] Oct. 10, 1978

[54] APPARATUS FOR AUTOMATICALLY DISPENSING MATERIAL FROM A ROLL

[76] Inventor: Alexander D'Angelo, 1813-15 E. Hart La., Philadelphia, Pa. 19134

[21] Appl. No.: 785,389

[22] Filed: Apr. 7, 1977

[51] Int. Cl.[2] ..... B65H 17/20; B65H 25/30

[52] U.S. Cl. ..... 226/136; 226/11; 226/141; 226/188; 242/57

[58] Field of Search ..... 226/134, 135, 136, 141, 226/139, 137, 11, 188; 242/57

[56] References Cited

U.S. PATENT DOCUMENTS

| | | | |
|---|---|---|---|
| 3,125,645 | 3/1964 | Cech | 226/188 X |
| 3,152,740 | 10/1964 | Kindseth et al. | 226/11 |
| 3,286,249 | 11/1966 | D'Angelo | 242/57 X |

FOREIGN PATENT DOCUMENTS

| | | | |
|---|---|---|---|
| 1,098,341 | 1/1968 | United Kingdom | 226/134 |

*Primary Examiner*—Bruce H. Stoner, Jr.
*Attorney, Agent, or Firm*—Seidel, Gonda & Goldhammer

[57] ABSTRACT

Apparatus for automatically dispensing material from a roll comprising a base and a cover pivotally mounted thereon, a roller for rotatably supporting a roll of material, and material engaging roller for automatically dispensing the material from the roll for at least two preselected time intervals under the control of an adjustable resistor-capacitor timing control circuit.

8 Claims, 6 Drawing Figures

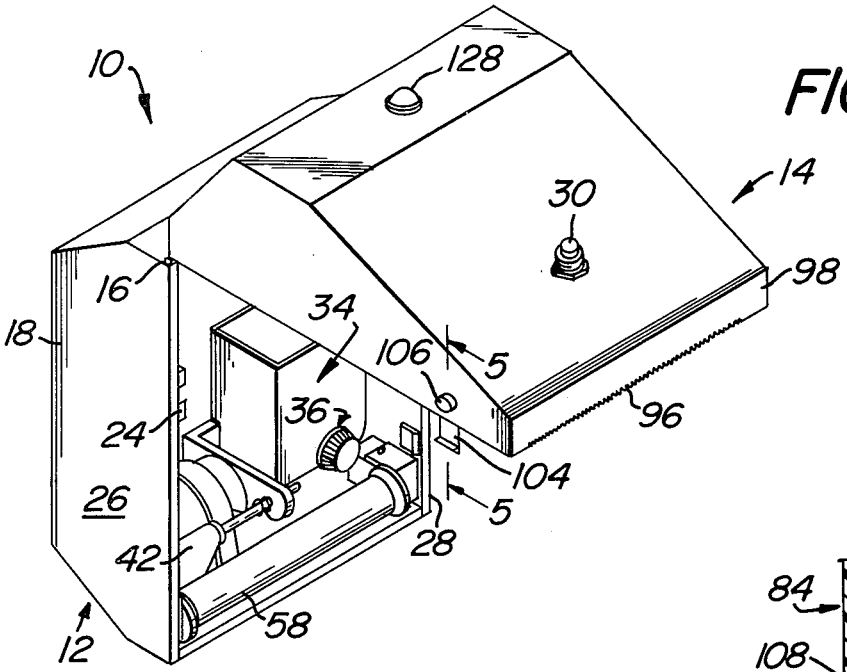
FIG. 1
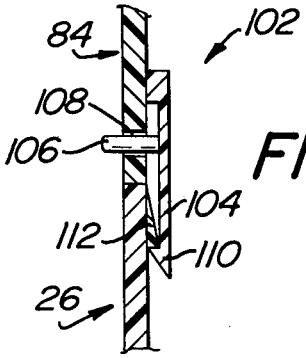
FIG. 5
FIG. 3
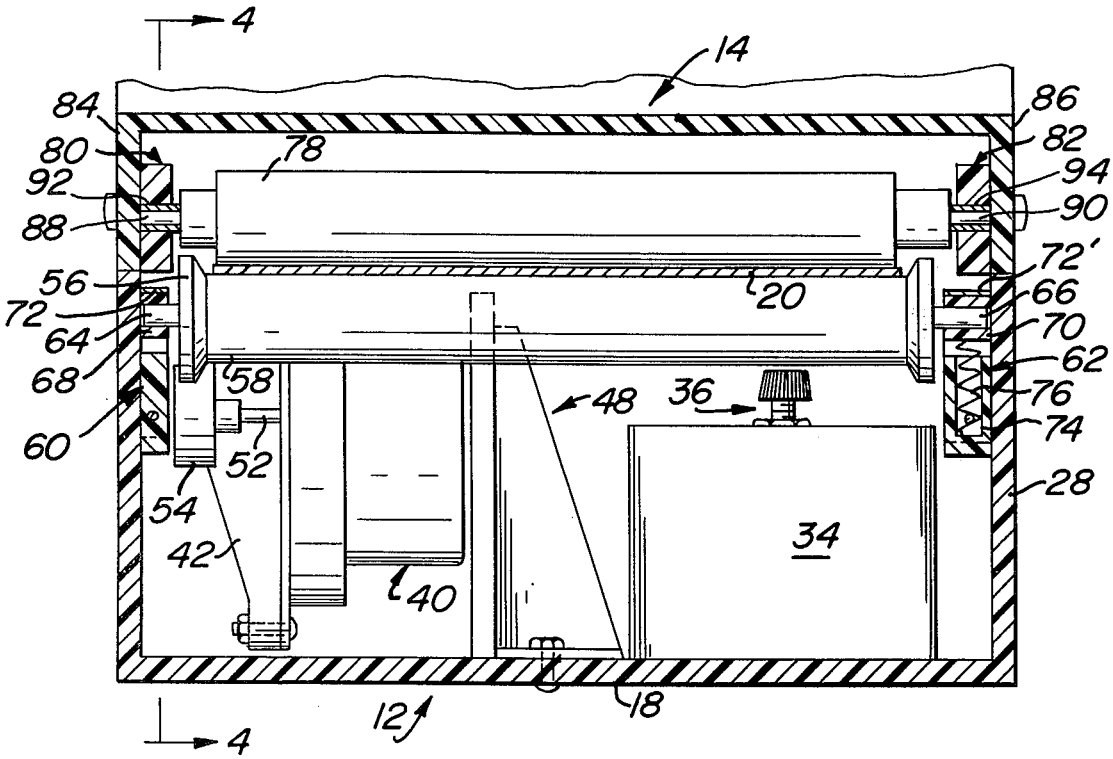

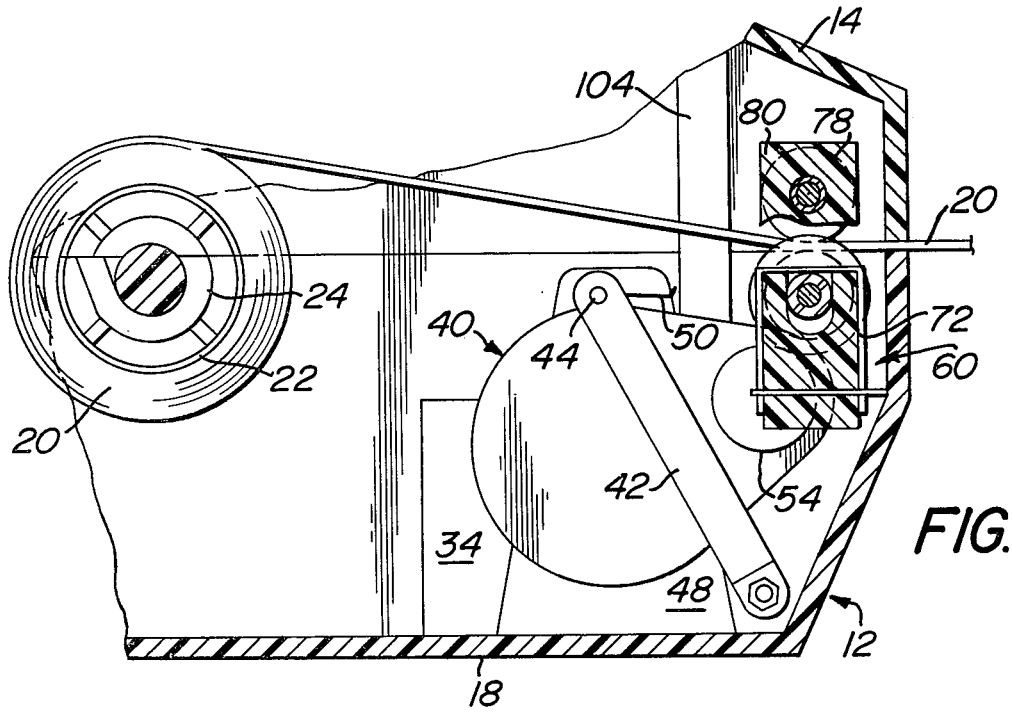
FIG. 4
FIG. 6
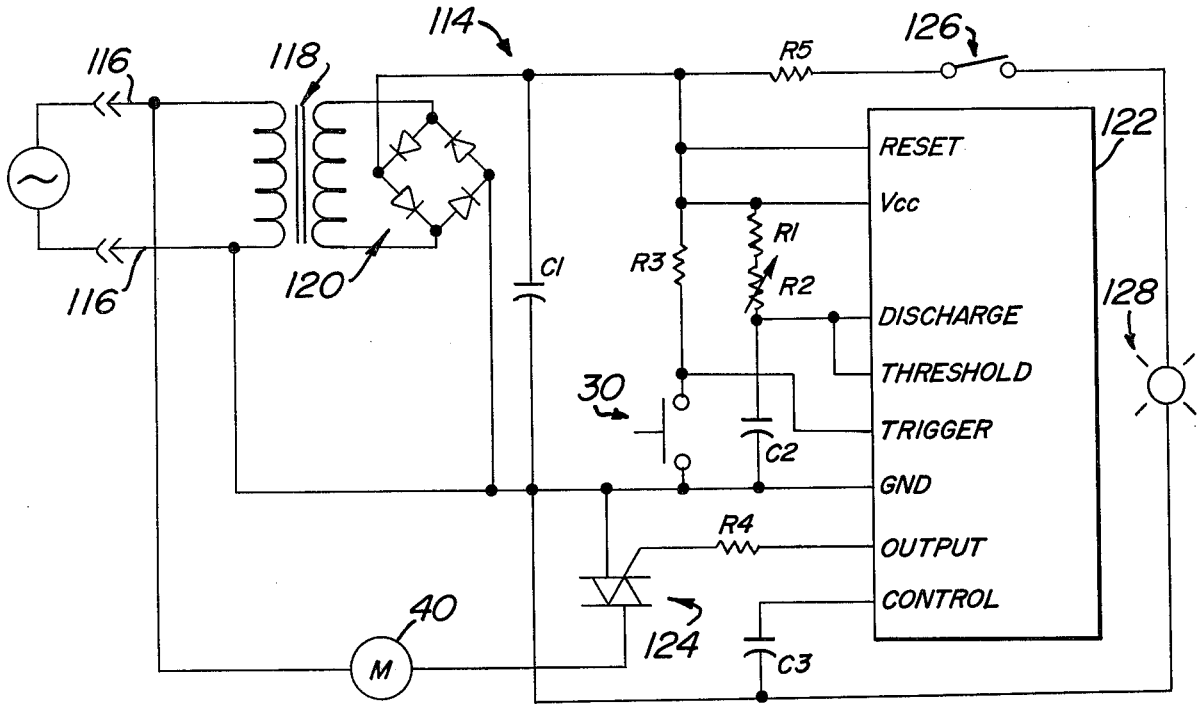

APPARATUS FOR AUTOMATICALLY DISPENSING MATERIAL FROM A ROLL

BACKGROUND OF THE INVENTION

The present invention is directed to apparatus for automatically dispensing material from a roll. In particular, the invention is directed to an apparatus for automatically dispensing material from a roll for preselected time intervals which may be conveniently adjusted by the user.

Automatic material dispensing apparatus are well known in the art. For example, see U.S. Pat. Nos. 3,210,139, 3,301,617, 3,297,269, 3,167,367 and 3,167,368. Such apparatus, however, is not truly automatic. Thus, such apparatus typically employs a motor connected in series to an on/off switch for dispensing material for a length of time which must be supervised by the user. The on/off switch must be continually depressed by the user to ensure continuous operation of the motor. Dispensing of material ceases only when the user releases control of the switch to stop the motor.

Continuous supervision of the dispensing apparatus by the user is an annoyance which may, under certain conditions, become intolerable. For example, in a hospital environment, a disabled person may not be able to continuously maintain the on/off switch in the proper state for dispensing of the material. Similarly, under adverse visual conditions, it may be difficult to ascertain the length of material dispensed by the apparatus. The desired length of dispensed material may not be reached or may be exceeded by the time the user releases the on/off switch to stop the motor. If the user is sightless, or if the lighting conditions are insufficient to render the dispensed material visible to the user, it becomes impossible to operate the on/off switch to cause the desired length of material to be dispensed from the apparatus.

Heretofore, relatively complicated and costly time control circuits have been improvised to control the cyclic operation of a motor. For example, see U.S. Pat. Nos. 3,942,086 and 3,864,611. Such circuits require a proliferation of solid state control elements. Such circuits may be difficult to install in the limited space available in a material dispensing apparatus of the type described herein. Moreover, the repair of such circuits may be quite troublesome due to the large number of components utilized therein and/or due to the specialized operation of certain components as demanded by the intended application. For example, U.S. Pat. No. 3,942,086 requires a control circuit for operating a portable power tool motor for extremely precise time intervals which are less than the response time of the user. Such a control circuit requires separate motor trigger signal circuit and voltage clamping circuit controls to accurately operate the motor. In the control of an automatic material dispensing apparatus of the type disclosed herein, however, it is desirable to employ as few components as possible to attain economy of space and to render repair of the apparatus simple and inexpensive.

A primary advantage of the present invention is that it automatically dipenses a preselected length of material without intervention of the user other than initiating operation of the invention.

Another advantage of the invention is that it can be conveniently used by disabled persons and/or under adverse visual conditions.

A further advantage of the invention is that it is relatively simple in assembly and easy to install in the limited space available.

A still further advantage of the invention is that it is relatively simple and inexpensive to repair.

Other advantages appear hereinafter.

BRIEF SUMMARY OF THE INVENTION

Apparatus for automatically dispensing material from a roll comprising a base, a cover pivotally mounted on the base, means for rotatably supporting a roll of material, and means for automatically dispensing the material from the roll for at least two preselected time intervals.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is an isometric view of an apparatus for automatically dispensing material from a roll in accordance with the principles of the present invention.

FIG. 3 is a bottom view of the apparatus taken along the lines 3—3 in FIG. 2.

FIG. 4 is a side view of the apparatus taken along the lines 4—4 in FIG. 3.

FIG. 5 is a view of the latch mechanism of the apparatus taken along the lines 5—5 in FIG. 1.

FIG. 6 is an electrical schematic of the timing control circuit for the apparatus.

DETAILED DESCRIPTION OF THE INVENTION

Figure 2:
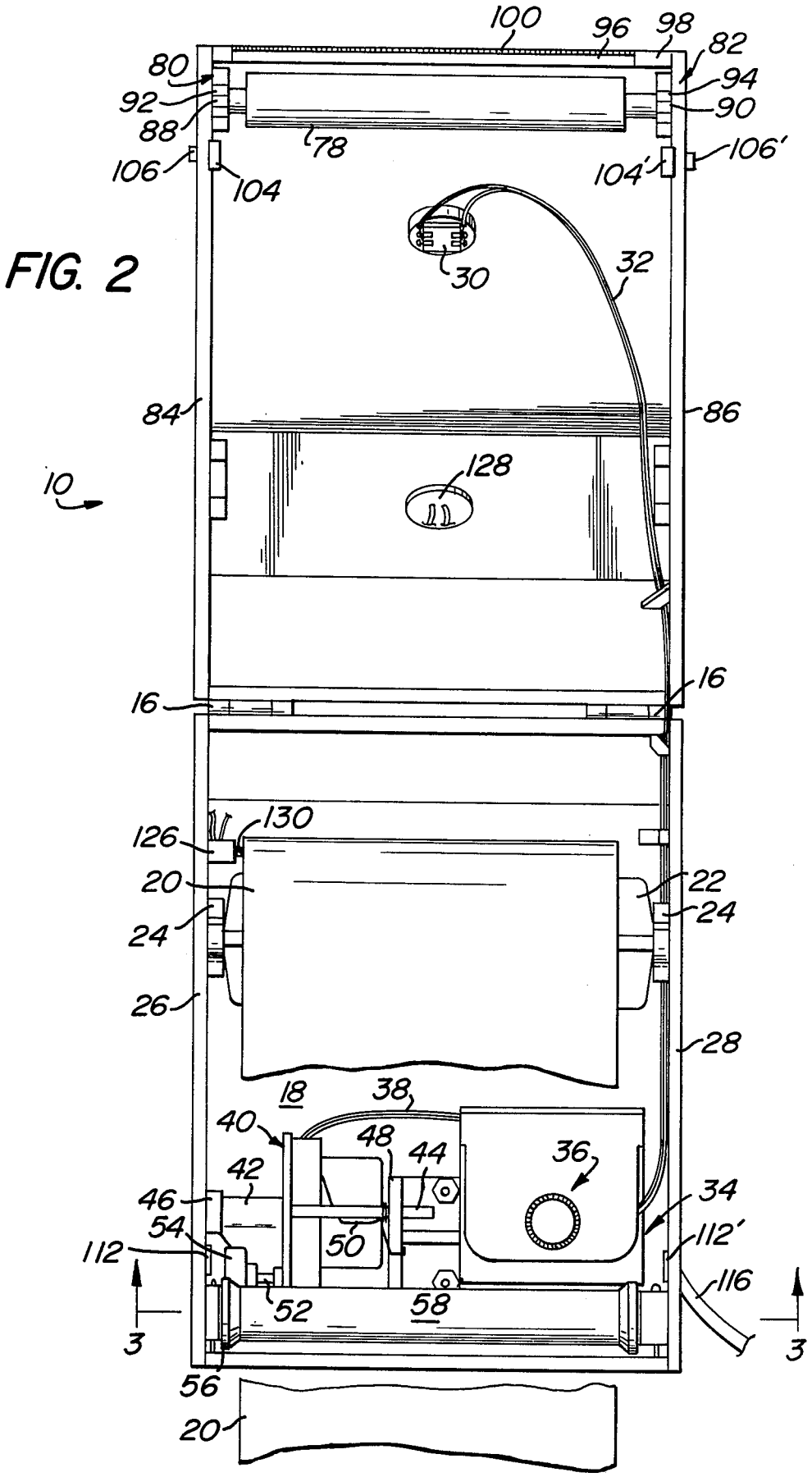
FIG. 2 is a front view of the apparatus in FIG. 1 in fully open condition.

Referring to the drawings in detail, wherein like numerals indicate like elements, there is shown in FIG. 1 an apparatus for automatically dispensing material from a roll in accordance with the principles of the present invention designated generally as 10. The apparatus 10 includes a base 12 and a cover 14 pivotally mounted on the base by means of hinges 16. Base 12 is provided with a rear wall 18 for mounting the apparatus on a vertical wall by any conventional means.

A roll 20 of material such as paper or the like is mounted on a dispensing roller 22. See FIG. 2. The dispensing roller 22 is journaled in a pair of bearings 24 secured to the side walls 26 and 28 of the base 12.

A switch 30 is secured to the cover 14 and is connected by leads 32 to a timing control circuit, described hereinafter, mounted in housing 34. The circuit includes an adjustable potentiometer having a dial 36 which is accessible to the user when the apparatus is open as shown in FIG. 2. The timing control circuit is connected by leads 38 to a motor 40. A spacer member 42 is screw mounted to one side of the motor 40. The spacer member 42 is secured to an arm 44 which is journaled in a bearing 46 mounted on side wall 26. Arm 44 extends through an aperture in the side of motor 40 and another aperture in a post 48 which is screw mounted to the rear wall 18 of base 12. A spring 50 is wrapped around arm 44. One end of the spring 50 presses against the top portion of motor 40, and the other end of the spring is wrapped around the post 48. Motor 40 includes a drive shaft 52 and a drive roller 54 mounted thereon. Spring 50 urges the drive roller 54 into frictional contact with the flanged end 56 of a driven roller 58. See FIGS. 2 and 3.

The driven roller 58 is journaled in bearings 60 and 62 mounted respectively on side walls 26 and 28 of base 12. See FIG. 3. In particular, the stub ends 64 and 66 of driven roller 58 extend respectively within plastic sleeves 68 and 70 disposed within bearings 60 and 62. Each of the bearings 60 and 62 is in the form of a clevis having a top metallic portion 72 and 72' respectively. Bearing 62 includes a compartment 74 in which a spring 76 is seated. Spring 76 urges the plastic sleeve 70 against the metallic top portion 72' of bearing 62.

An idler roller 78 is journaled in a pair of bearings 80 and 82 secured respectively to the side walls 84 and 86 of cover 14. In particular, the stub ends 88 and 90 of idler roller 78 extend respectively within plastic sleeves 92 and 94 disposed within bearings 80 and 82.

When cover 14 is closed on base 12, idler roller 78 rests on driven roller 58 and plastic sleeves 92 and 94 may rest on top metallic portions 72 and 72' of bearings 60 and 62. Prior to closure of cover 14 on base 12, material 20 is drawn between idler roller 78 and driven roller 58 and through an elongated opening 96 in the front wall 98 of cover 14. See FIGS. 2, 3 and 4. The front wall 98 of cover 14 is provided with a serrated edge 100 along the opening 96. Dispensed material 20 can be lifted against the serrated edge 100 and torn away for use.

The apparatus 10 includes a pair of latches 102, each of which are disposed on one of the sides of the apparatus. Latches 102 comprise identical elements. For purposes of description herein, it is deemed necessary only to describe the structure and operation of one latch 102, the structure and operation of the other latch being the same. Latch 102 is disposed along side walls 84 and 26 of cover 14 and base 12 respectively. The other latch is disposed along side walls 86 and 28 of cover 14 and base 12 respectively. Latch 102 comprises a finger 104 mounted on side wall 84. The finger 104 may be flexed inwardly by depression of a post 106 which is mounted on the finger and which extends through an aperture 108 in side wall 84. Finger 104 is provided with an edge portion 110 which mates with a wedge-shaped keeper 112 mounted on side wall 26 of base 12. In closing cover 14 on base 12, the edge portion 110 of finger 104 slides over keeper 112 and mates with the underside of keeper 112. See FIG. 5. With the finger 104 and keeper 112 in this position, the cover 14 remains closed against the base 12.

To open cover 14 from base 12, the user depresses post 106 to cause the finger 104 to flex inwardly to free the edge portion 110 from keeper 112. The cover 14 can then be pivoted upwardly about hinges 16 to obtain access to the roll 20 or any other element within the interior of the apparatus.

The length of material 20 dispensed by the apparatus is determined by the operation of a timing control circuit 114 disposed within housing 34. See FIG. 6. Power is obtained from a conventional a-c outlet through leads 116. The a-c power is converted to d-c means of a transformer 118 and full-wave bridge rectifier 120. Transformer 118 may be a 120/6.3 volt a-c transformer. Bridge rectifier 120 may be a 1 watt rectifier.

The d-c output of bridge rectifier 120 is held by a capacitor C1. The dispensing roller 52 is selectively driven by means of timer 122, switch 30 and motor 40. Timer 122 may be a Motorola MC 1555 precision timer connected to operate in the monostable mode. When switch 30 is open, the output of timer 122 maintains a triac 124 off. Depressing switch 30 triggers the timer 122. When triggered, the timer output gates the triac 124 on, causing the motor 40 to operate. At the same time, timing capacitor C2 charges to the d-c output of bridge rectifier 120 via resistors R1 and R2. Resistor R2 is a potentiometer which is adjustable by manipulation of dial 36. When the capacitor C2 charges to a level in excess of a threshold voltage, the output of timer 122 gates the triac 124 off, causing the motor 40 to stop. The capacitor C2 thereafter discharges very quickly.

The timer 122 is triggered by momentary depression of switch 30. The switch 30 is released while the capacitor C2 charges to the threshold voltage. Prior to operation of the apparatus, potentiometer R2 is adjusted by means of dial 36 to provide the desired on time for triac 124. The on time of triac 124 determines the interval of operation of motor 40, hence the length of material 20 dispensed by the apparatus after actuation of switch 30. The on time of triac 124 is determined by the following approximate relationship:

$$\text{On time} \cong 1.1\ (R1 + R2)\ (C2)$$

Preferably, resistors R1 and R2 and capacitor C2 are chosen to provide an on time of approximately 3.75 to 25.75 seconds. The limits of the on time of triac 124 determine the minimum and maximum lengths of material 20 dispensed by the apparatus.

Timing control 114 also includes a follower actuated switch 126 in series with a resistor R5 and an alarm device 128. Switch 126 is mounted on side wall 26 of base 14. See FIG. 2. The switch is provided with a follower 130 which abuts against the side of roll 20. When a preselected length of material 20 has been dispensed by the apparatus, the diameter of roll 20 falls below the position of follower 130 and the follower springs forward to close switch 126. As a result, alarm device 128 is actuated to indicate to the user that roll 20 should be replaced shortly by a new roll. Alarm device 128 is preferably mounted on the top surface of cover 14. The alarm device 128 is preferably a light emitting diode.

In the preferred embodiment of the invention described herein, timing control circuit 114 comprises the components listed in Table 1 below.

Table 1

| Component | Parameters |
|---|---|
| 126 | SPST follower actuated switch |
| 30 | SPST push button switch |
| 118 | 120/6.3 volt a-c transformer |
| 120 | 1 watt bridge rectifier |
| Cl | 350 μfd/15 wvdc |
| C2 | 10 μfd/15 wvdc |
| C3 | 0.01 μfd/15 wvdc |
| 124 | Motorola R1723 triac |
| R1 | 340 K Ω/¼ watt |
| R2 | 2 MΩ potentiometer |
| R3 | 10 KΩ/¼ watt |
| R4 | 100 Ω/¼ watt |
| R5 | 86 Ω/¼ watt |
| 128 | 1.7 v led |

In operation, the user manipulates dial 36 to adjust potentiometer R2 to the desired setting. Dial 36 may be calibrated in terms of the on times of triac 124 or, preferably, in terms of the length of material 20 dispensed by the apparatus for specific on times of the triac. Cover 14 is then closed on base 12 and latched in position by means of latches 102. Switch 30 is depressed momentarily to initiate operation of motor 40. The motor 40 drives the driven roller 58 to dispense material 20 between the driven roller and idler roller 78. When the preselected length of material 20 is dispensed by the apparatus, the motor 40 is automatically stopped. The dispensed material can be lifted by the user and torn off against serrated edge 100 of cover 14. If, at any time, the length of material remaining on roll 20 drops below a preselected length, switch 126 is automatically closed by means of follower 130 and alarm device 128 is actuated to indicate to the user that a new roll should be inserted in the apparatus.

An advantage of the invention is that it provides truly automatic dispensing of preselected lengths of material without continuous supervision by the user. The invention is particularly suitable for use in a hospital environment. A patient need only depress switch 30 momentarily to initiate operation of the apparatus. Further supervision by the patient is not required. The invention is easily operated by persons having impaired vision since it is not required to visually measure the length of material dispensed by the apparatus before terminating operation thereof.

Moreover, the invention comprises relatively few electrical components which can be easily installed in the limited space typically available for such apparatus. The invention is reliable, simple to maintain and easy to repair. The invention is particularly useful in public rest areas since it requires a minimum of supervision by the user and allows easy replacement of depleted rolls of material by the user.

Additionally, when the invention is not being operated, only a small length of material protrudes through the elongated opening 96 in cover 14. Accordingly, the roll 20 is protected by the cover 14 and base 12 from unsanitary environmental conditions.

Although the invention has been described in terms of specific structure and electronic components, it should be obvious that other equivalent structure and components could be substituted for those described herein without exceeding the spirit or scope of the invention. For example, if desired, the transformer 118 and bridge rectifier 120 can be replaced by a battery and the motor 40 can be replaced by its battery operated equivalent.

The present invention may be embodied in other specific forms without departing from the spirit or essential attributes thereof and, according, reference should be made to the appended claims, rather than to the foregoing specification as indicating the scope of the invention.

I claim:

1. An electrical paper roll dispenser comprising:

a base;

a cover pivotally mounted on said base;

means for rotatably supporting a paper roll within said base;

a driven roller rotatably mounted on said base forwardly of said means for rotatably supporting said paper roll;

an idler roller rotatably mounted on said cover, said idler roller being disposed within said cover to rest on said driven roller upon closure of said cover on said base;

a motor having a drive shaft and roller mounted thereon for frictionally driving said driven roller;

a triac connected to said motor for controlling the operation of said motor;

a monostable timer connected to said triac for controlling the state of said triac;

a switch mounted on said cover and connected to said monostable timer for selectively actuating the same; and a timing capacitor connected to said monostable timer and an adjustable potentiometer connected to said timing capacitor for causing said timer to maintain said triac on for a preselected interval of time upon actuation of said switch.

2. The apparatus according to claim 1 including means for sensing the level of said paper roll, and an alarm device operatively connected thereto.

3. The apparatus according to claim 1 wherein said alarm device is a light emitting diode.

4. The apparatus according to claim 1 including means for pivotally mounting said motor on said base and spring means for urging said motor roller into frictional contact with said driven roller.

5. An apparatus for automatically dispensing material from a roll, comprising:

a base, said base having a side wall;

a cover pivotally mounted on said base, said cover having a side wall provided with an aperture;

a wedge-shaped keeper secured to said base side wall;

a flexible finger disposed within said cover, said flexible finger being secured to said cover side wall, said finger having a post which extends through said aperture for access exterior to said cover side wall, said finger having an edge portion which depends below said side wall, said edge portion being slidable over said wedge-shaped keeper for mating engagement therewith upon closure of said cover on said base, said edge portion being adapted for disengagement from said keeper upon depression of said post within said aperture;

means for rotatably supporting a roll of material;

a driven roller rotatably mounted on said base forwardly of said means rotatably supporting said roll of material;

an idler roller rotatably mounted on said cover, said idler roller being disposed within said cover to rest on said driven roller upon closure of said cover on said base;

a motor having a drive shaft and roller mounted thereon for frictionally driving said driven roller;

a resistor-capacitor timing control circuit operatively connected to said motor for energizing said motor for an adjustable preselected time interval; and a switch mounted on said cover and operatively connected to said timing control circuit for selectively actuating the same.

6. The apparatus according to claim 5 wherein said timing control circuit includes a triac connected to said motor for controlling the operation of said motor, a monostable timer connected to said triac for controlling the state of said triac, a timing capacitor and an adjustable potentiometer connected to said capacitor for causing said timer to maintain said triac on for a preselected interval of time upon actuation of said switch.

7. The apparatus according to claim 6 incuding means for sensing the level of said roll of material, and an alarm device operatively connected thereto.

8. The apparatus according to claim 6 including means for pivotally mounting said motor on said base and spring means for urging said motor roller into frictional contact with said driven roller.

* * * * *